US005531451A

United States Patent [19]

Yiu

[11] Patent Number: 5,531,451

[45] Date of Patent: Jul. 2, 1996

[54] SCORING SYSTEM FOR DART GAMES

[76] Inventor: Chih-Hao Yiu, P.O. Box 1750, Taichung, Taiwan

[21] Appl. No.: 422,247

[22] Filed: Apr. 14, 1995

[51] Int. Cl.[6] ..... F41J 3/02

[52] U.S. Cl. ..... 273/371

[58] Field of Search ..... 273/371, 373, 273/378

[56] References Cited

U.S. PATENT DOCUMENTS

| | | | |
|---|---|---|---|
| 2,837,336 | 6/1958 | Brown | 273/373 |
| 4,678,194 | 7/1987 | Bowyer et al. | 273/373 |
| 4,852,888 | 8/1989 | Ross et al. | 273/373 |
| 5,314,195 | 5/1994 | Schulze | 273/371 |
| 5,318,319 | 6/1994 | Jones et al. | 273/371 |
| 5,419,549 | 5/1995 | Galloway et al. | 273/371 X |

*Primary Examiner*—William E. Stoll
*Attorney, Agent, or Firm*—Charles E. Baxley

[57] ABSTRACT

A scoring system for a cricket dart game includes three "8"-shaped display units each having seven strokes. The three display units include twenty one strokes in total and the twenty one strokes are divided into seven groups each having three stokes for indicating three shots of a particular scoring. The display units are good enough for scoring a cricket dart game without installing further light bulbs.

1 Claim, 5 Drawing Sheets

15

16

17

18

19

20

Bull

SCORING SYSTEM FOR DART GAMES

BACKGROUND OF THE INVENTION

1. Field of the Invention

The present invention relates to a dart game, and more particularly to a scoring system for a dart game.

2. Description of the Prior Art

A typical dart game is shown in FIG. 1 and comprises a target area 10 to be shot by a dart, and a display means 11 for displaying the scores. The display means may include a video display screen, liquid crystal display, electronic display or the like. Typical dart games comprise a number of different rules including "count up or count down", "301-901", "round the clock" and "cricket". For cricket or the so-called "mickey mouse", the users have to shoot three times for each of the target plates scoring from 15 to 20 and the bull. In order for scoring purposes, seven groups of light bulbs 12 are provided for scoring the shooting of the target plates scoring from 15 to 20 and the bull. In the begining, all of the seven groups of light bulbs are turned on. When the users shoot a target plate scoring "15", one of the group of the light bulbs scoring "15" will be turned off. The winner should first shoot and turn off all of the light bulbs 12. The display means 11 is provided for showing the scoring ranging from 15 to 20 only. However, The light bulbs 12 are required for scoring the "CRICKET" dart game. This not only may increase the size of the dart board but also may increase the manufacturing cost thereof.

The present invention has arisen to mitigate and/or obviate the afore-described disadvantages of the conventional scoring systems for cricket dart games.

SUMMARY OF THE INVENTION

The primary objective of the present invention is to provide a scoring system for cricket dart games which may be provided for scoring purposes without installing further light bulbs.

In accordance with one aspect of the invention, there is provided a scoring system for a cricket dart game comprising three "8"-shaped display units each including seven strokes, the three display units including twenty one strokes in total, the twenty one strokes being divided into seven groups each including three stokes for indicating three shots of a particular scoring. The display units are good enough for scoring purposes without installing further light bulbs.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
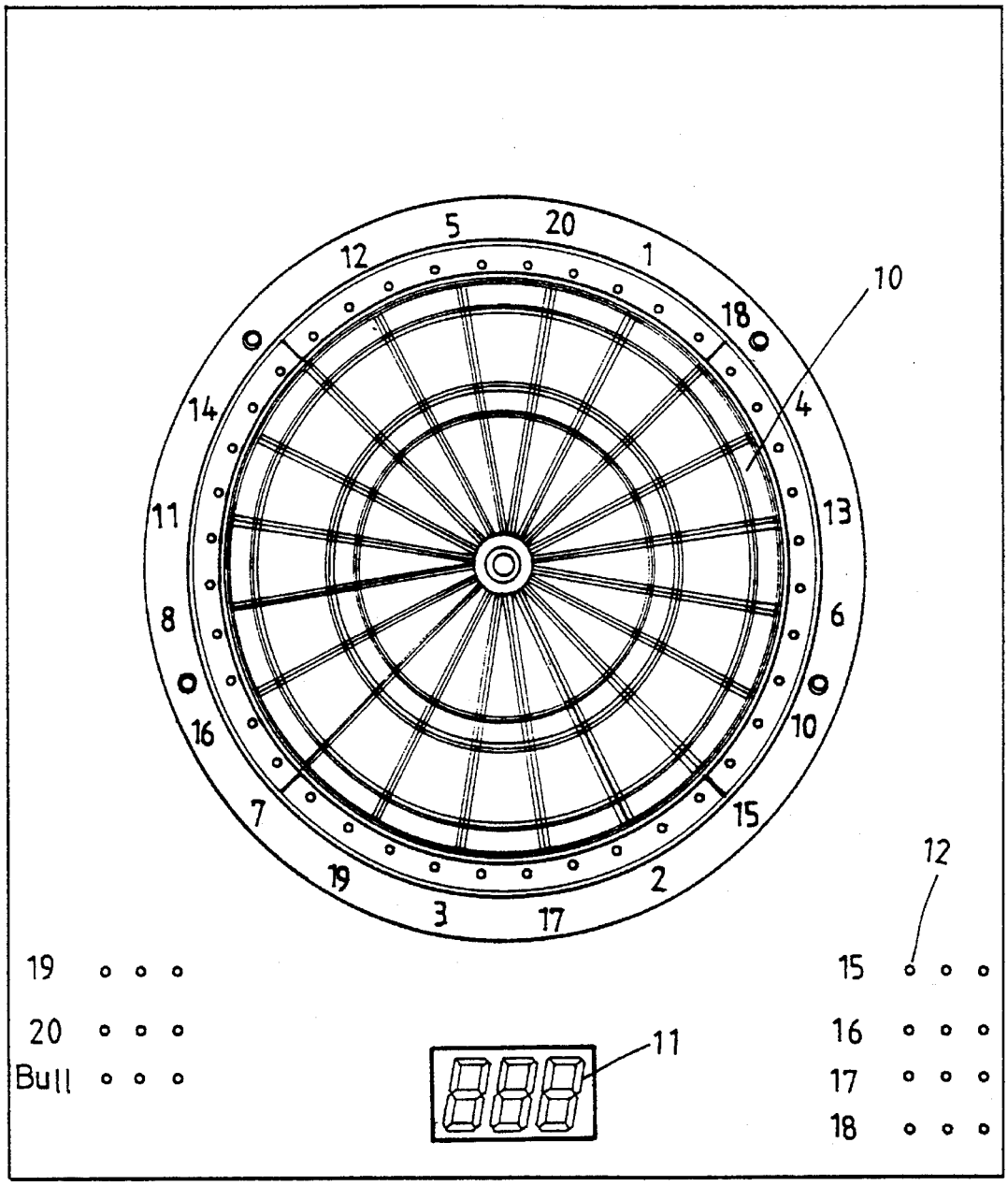
FIG.1 PRIOR ART
FIG. 1 is a plane view showing a typical dart game.
Figure 2:
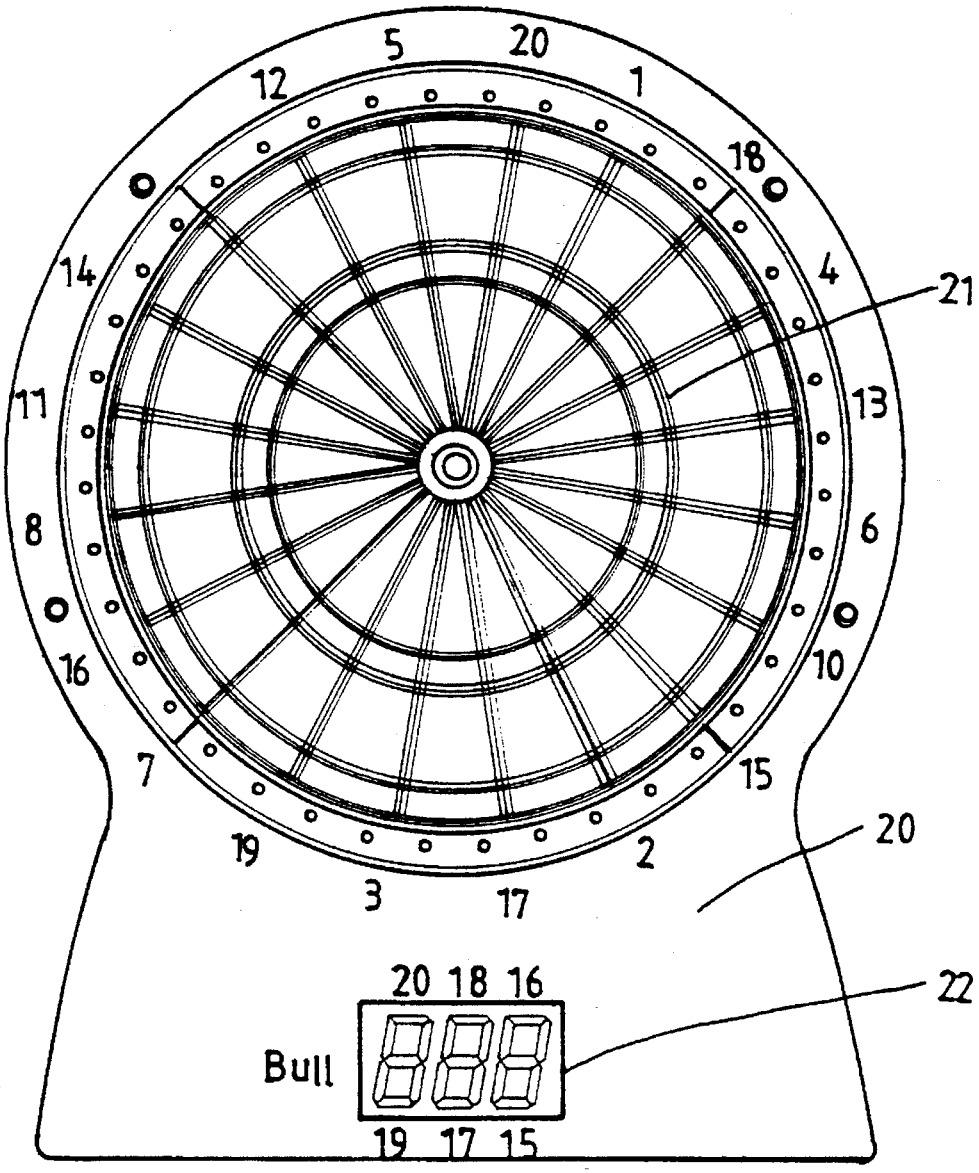
FIG. 2 is a plane view of a dart game in accordance with the present invention.

Referring to FIG. 2, a dart game in accordance with the present invention comprises a dart board 20 having a dart area 21 provided in the upper portion and having a display means 22 provided in the lower portion for scoring purposes.

Figure 3:
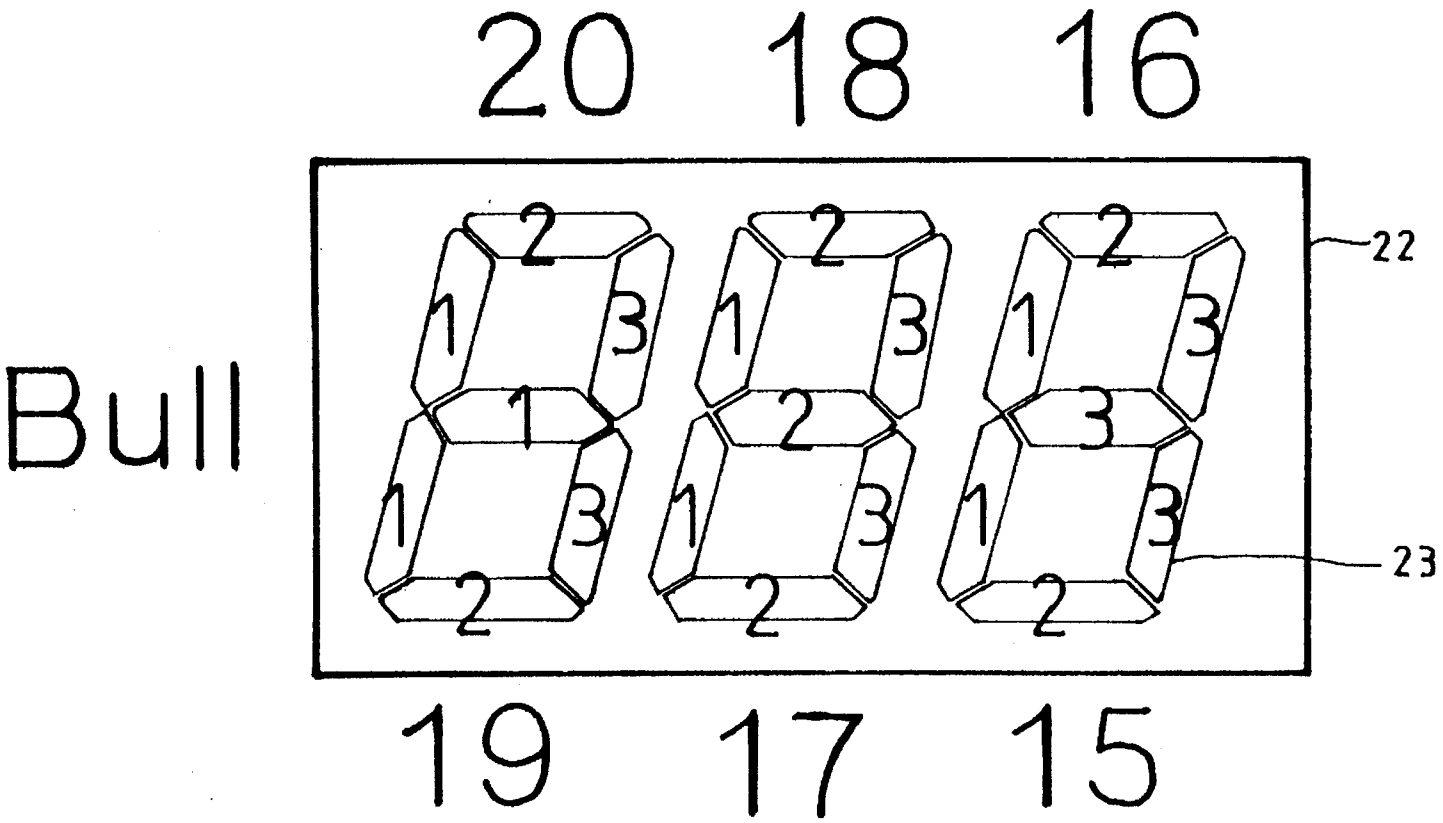
FIG. 3 is a plane view of a display means.
Figure 4:
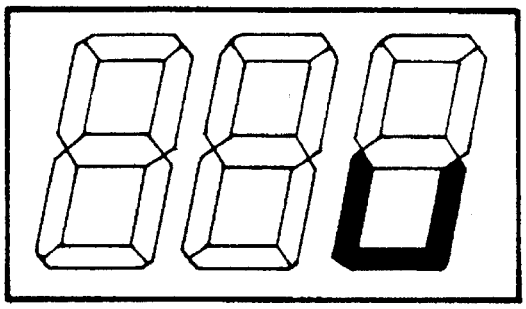
FIGS. 4, 5, 6, 7, 8, 9, 10 are plane views of the display means illustrating the scoring system for the dart game.
Figure 5:
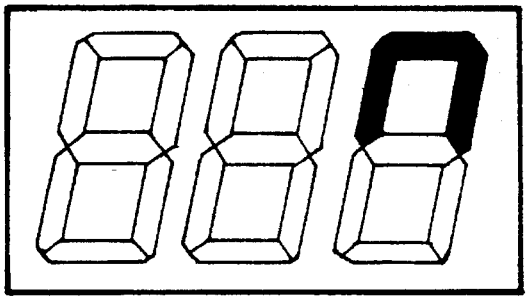
Figure 6:
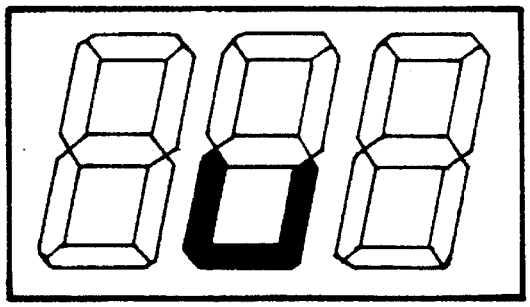
Figure 7:
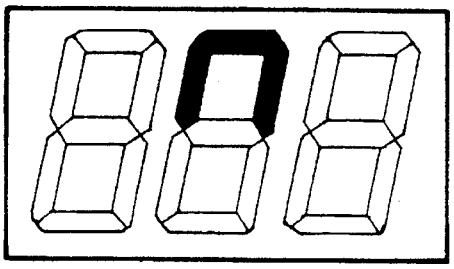
Figure 8:
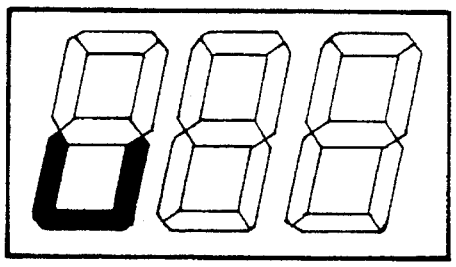
Figure 9:
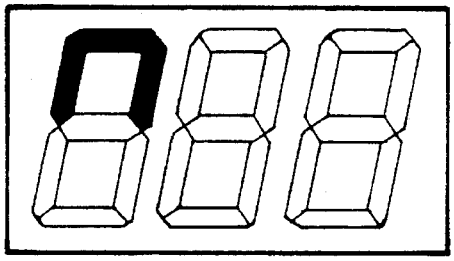
Figure 10:
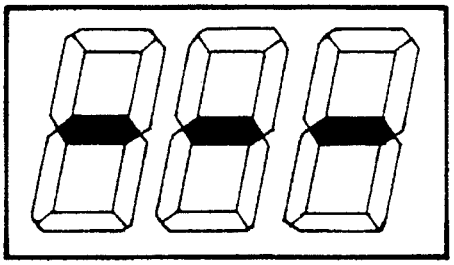

As shown in FIG. 3, the display means 22 may include a video display screen, liquid crystal display, electronic display or the like, and include three "8"-shaped display units 23 each having seven strokes arranged in "8" shape. The three display units 23 includes twenty one strokes altogether which is just good enough for scoring the twenty one shots of the cricket dart game. As shown in FIG. 4, the lower three strokes of the right "8"-shaped display unit 23 are provided for indicating the three shots of score "15". As shown in FIG. 5, the upper three strokes of the right unit 23 are provided for scoring the three shots of scoring "16". Similarly, as shown in FIGS. 6 to 9, other upper and lower group of strokes of the other units 23 may be provided for indicating the three shots of the scores "17, 18, 19, 20" respectively. As shown in FIG. 10, the middle stroke of the three display units 23 may be provided for scoring the three shots to the bull.

Typically, the three display units 23 are provided for indicating numerals from 0 to 9 only. The numerals each includes at least two strokes, such as "1". The dart area 21 includes a number of slidable segments connected to a microprocessor means which is connected to the display units 23 of the display means 22 via a driver or a scanner means. The display units 23 may be controlled to display the numerals or the strokes by the microprocessor means. However, the microprocessor means and the driver or scanner means are not related to the invention and will not be described in further details.

In operation and in the beginning, all of the twenty one strokes of the three display units 23 are turned on. When the dart plate scoring "19" is shot, one stroke of the three lower strokes of the left display unit 23 is turned off. When three "19" shots are completed and when a further "19" scoring is shot, no further strokes will be turned off. When the first person shoots and turns off all of the strokes, he is the winner.

Similarly and alternatively, all of the uppermost strokes of the three display units 23 may be provided for scoring a particular scoring, such as "16"; the three upper and left strokes of the three display units may be provided for scoring "17" for example. The three bottommost strokes of the display units 23 may be provided for display the three shots of the bull.

Accordingly, the scoring system for dart games in accordance with the present invention may be provided for scoring cricket dart game without further installing light bulbs.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for scoring a cricket dart game, said method comprising:

preparing a dart board having a scoring area provided therein for responding to a plurality of shots of at least one dart, preparing three "8"-shaped display units and connecting said display units to said scoring area of said dart board, said display units each including seven strokes such that said three display units include twenty one strokes in total, said twenty one strokes being divided into seven groups each including three strokes for indicating three shots of a scoring, said twenty one strokes each being provided for indicating one of the shots, and actuating said seven groups of said twenty one strokes for indicating the shots of the dart so as to score the cricket dart game.

* * * * *